US011193660B2

(12) United States Patent
Wang et al.

(10) Patent No.: US 11,193,660 B2
(45) **Date of Patent: *Dec. 7, 2021**

(54) OPTICAL ELEMENT, A LIGHTING APPARATUS AND A LIGHTING LAMP WITH THE LIGHTING APPARATUS

(71) Applicant: OPPLE LIGHTING CO., LTD., Shanghai (CN)

(72) Inventors: Guoping Wang, Shanghai (CN); Hongbo Wang, Shanghai (CN); Feng Li, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/026,670

(22) Filed: Sep. 21, 2020

(65) Prior Publication Data

US 2021/0003274 A1 Jan. 7, 2021

Related U.S. Application Data

(63) Continuation of application No. 15/945,809, filed on Apr. 5, 2018, now Pat. No. 10,816,178, which is a (Continued)

(30) Foreign Application Priority Data

Dec. 3, 2015 (CN) ..... 201510876262.9
Dec. 3, 2015 (CN) ..... 201520990112.6

(51) Int. Cl.
*F21V 23/00* (2015.01)
*F21V 5/00* (2018.01)

(Continued)

(52) U.S. Cl.
CPC ..... *F21V 23/005* (2013.01); *F21V 5/00* (2013.01); *F21V 5/002* (2013.01); *F21V 17/12* (2013.01);

(Continued)

(58) Field of Classification Search
CPC ..... F21V 23/005; F21V 23/003; F21V 5/00; F21V 5/002; F21V 5/046; F21V 17/12; F21V 17/16; F21Y 2103/33

(Continued)

(56) References Cited

U.S. PATENT DOCUMENTS 7,416,312 B1 * 8/2008 McDermott ..... F21V 5/046 362/216
7,997,774 B2 * 8/2011 Liddle ..... F21V 14/02 362/398

(Continued)

FOREIGN PATENT DOCUMENTS

CN 202419256 U 9/2012
CN 203810221 U 9/2014

(Continued)

*Primary Examiner* — Laura K Tso
(74) *Attorney, Agent, or Firm* — Arch & Lake LLP

(57) ABSTRACT

A lighting apparatus includes a light source circuitry and an optical element. The light source circuitry has a light source baseplate, a plurality of light-emitting units arranged in an annular shape on the light source baseplate, and a driving circuitry located in an annular region surrounded by the light-emitting units on the light source baseplate. The optical element includes an annular optical accommodation region at an outer periphery and a driving accommodation region protruded from the optical accommodation region and is disposed in a region surrounded by the optical accommodation region. The optical accommodation region includes an optical accommodation groove which is facing the light-emitting units and configured to accommodate the light-emitting units. Light emitted by the light-emitting units is incident onto the optical accommodation groove and then exits upon being distributed; and the driving circuitry of the (Continued)

light source circuitry is correspondingly accommodated in the driving accommodation region.

19 Claims, 8 Drawing Sheets

Related U.S. Application Data continuation of application No. PCT/CN2016/107322, filed on Nov. 25, 2016.

(51) Int. Cl.
*F21Y 103/33* (2016.01)
*F21Y 115/10* (2016.01)
*F21V 17/12* (2006.01)
*F21V 17/16* (2006.01)

(52) U.S. Cl.
CPC ..... *F21V 17/16* (2013.01); *F21Y 2103/33* (2016.08); *F21Y 2115/10* (2016.08)

(58) Field of Classification Search
USPC ..... 362/249.06, 249.02, 216
See application file for complete search history.

(56) References Cited

U.S. PATENT DOCUMENTS 9,945,544 B1 * 4/2018 Lee ..... A01K 31/18
10,098,210 B2 * 10/2018 Arai ..... F21S 8/00
10,352,535 B2 * 7/2019 Zhu ..... F21V 17/10
10,816,178 B2 * 10/2020 Wang ..... F21V 5/00
2010/0208474 A1 8/2010 Hancock et al.
2010/0302758 A1 * 12/2010 Wang ..... F21V 33/0076 362/20
2012/0300455 A1 * 11/2012 Breidenassel ..... F21V 29/77 362/235
2013/0010473 A1 * 1/2013 Dellian ..... F21V 19/004 362/249.02
2013/0027938 A1 * 1/2013 Hisayasu ..... F21V 17/005 362/249.02
2013/0044478 A1 * 2/2013 Steedly ..... F21K 9/23 362/235
2014/0029252 A1 * 1/2014 Kato ..... F21V 23/002 362/235
2014/0071678 A1 * 3/2014 Chen ..... F21K 9/232 362/249.02

FOREIGN PATENT DOCUMENTS

CN 203927627 U 11/2014
CN 105371125 A 3/2016
CN 205226917 U 5/2016
GN 203375364 U 1/2014
GN 203907320 U 10/2014
WO 2015144645 A1 10/2015

* cited by examiner

OPTICAL ELEMENT, A LIGHTING APPARATUS AND A LIGHTING LAMP WITH THE LIGHTING APPARATUS

CROSS-REFERENCE TO RELATED APPLICATIONS

This application is a continuation application for U.S. patent application Ser. No. 15/945,809, which claims the priority of PCT patent application No. PCT/CN2016/107322 filed on Nov. 25, 2016 which claims the priority of Chinese Patent Application No. 201510876262.9 filed on Dec. 3, 2015, and Chinese Patent Application No. 201520990112.6 filed on Dec. 3, 2015, the entire contents of all of which are hereby incorporated by reference herein for all purposes.

TECHNICAL FIELD

The present disclosure relates to an optical element, a lighting apparatus and a lighting lamp with the lighting apparatus.

BACKGROUND

Lighting is a measure of illuminating work places and living places or individual objects by means of various light sources. The way of using sunlight and sky light is called "natural lighting" while the way of using an artificial light source is called "artificial lighting." The primary purpose of lighting is to create a good visibility and a comfortable environment.

With the booming of lighting market, various types of lighting lamps have been emerged endlessly. Compared with traditional light sources, lighting by using light-emitting diodes (LEDs) has characteristics such as small size, energy saving, long life, high brightness and environmental protection. In the field of lighting, the application of LED light-emitting products is attracting the attention of the world. As a new type of environmentally friendly light source product, LED is bound to be the future trend of development. In the 21st century, people will enter a novel lighting light source age represented by LED.

Generally, a plurality of LED light-emitting units is integrated on a single printed circuit board (PCB). Each of the LED light-emitting units is covered by a separately arranged lens unit. In this way, multiple lens units are separately disposed on a light source baseplate, which is time-consuming and energy-wasting, and also difficult to guarantee the quality. Moreover, due to such separately arranged lens units, a protection cover is additionally required to protect a circuit on a portion of the light source baseplate not covered by the lens unit, and a manufacturing process thereof is relatively complicated.

In addition, the light source baseplate is usually arranged in a circle shape or in an annular shape. Therefore, a large amount of waste materials will be generated during cutting and trimming, thereby resulting in high cost.

Therefore, there is a need for a safe and reliable LED lamp with a simple manufacturing process, and a LED light source circuitry applied in such LED lamp.

SUMMARY

In order to overcome the above-mentioned technical defects, an objective of the present disclosure is to provide a low-cost lighting apparatus.

Another objective of the present disclosure is to provide an optical element.

Yet another objective of the present disclosure is to provide a lighting lamp with the above-mentioned lighting apparatus.

A first aspect of the present disclosure provides a lighting apparatus including a light source circuitry and an optical element. The light source circuitry has a light source baseplate, a plurality of light-emitting units arranged in an annular shape on the light source baseplate, and a driving circuitry located in an annular region surrounded by the light-emitting units on the light source baseplate. The optical element includes an annular optical accommodation region located at an outer periphery and a driving accommodation region which is protruded higher from the optical accommodation region and is disposed in a region surrounded by the optical accommodation region; the optical accommodation region is provided with an optical accommodation groove which is facing the light-emitting units and configured to accommodate the light-emitting units; light emitted by the light-emitting units is incident onto the optical accommodation groove and then exits upon being distributed; and the driving circuitry of the light source circuitry is correspondingly accommodated in the driving accommodation region.

A second aspect of the present disclosure provides an optical element. The optical element includes: an annular optical accommodation region located at an outer periphery, and a driving accommodation region which is protruded and is located in a region surrounded by the optical accommodation region. The optical accommodation region is provided with an optical accommodation groove which is configured to be facing the light-emitting units and accommodate the light-emitting units; light emitted by the light-emitting units is incident onto the optical accommodation groove, and then exits upon being distributed; and the driving circuitry of the light source circuitry is correspondingly accommodated in the driving accommodation region.

A third aspect of the present disclosure provides a lighting lamp. The lighting lamp includes a chassis and any one of the foregoing lighting apparatus. The lighting apparatus is attached onto the chassis by an attractive force.

The lighting apparatus, the optical element and the lighting lamp provided by the present disclosure provide a better optical processing and a better insulation level through the annular optical accommodation region and the driving accommodation region provided by the optical element.

The above description is merely an overview of the technical solutions of the present disclosure. In order to allow clearly understanding of the technical solutions of the present disclosure so that the present disclosure can be implemented according to the contents of the specification, and in order to make the above and other objectives, features and advantages of the present disclosure more apparent, specific embodiments of the present disclosure are described below.

BRIEF DESCRIPTION OF THE DRAWINGS

Various other advantages and benefits will become apparent to those ordinary skilled in the art upon reading the following detailed description of the preferred embodiments. The drawings are only for the purpose of illustrating the preferred embodiments and are not to be construed as a limit of the disclosure. Also, throughout the drawings, the same reference numerals will be used to refer to the same elements/members/parts. In the drawings.

DETAILED DESCRIPTION

The present disclosure will be described in further details below with reference to preferred embodiments. The following preferred embodiments are used to illustrate the present disclosure, but not to limit the scope of the present disclosure.

In the description of the present disclosure, it should be noted that the directions or positional relationships indicated by the terms "above", "below", "up and down direction", "left and right direction", "front and back direction" are merely for the convenience of describing the present disclosure and simplifying the description, rather than indicating or implying that the indicated apparatus or element must have a specific orientation and be constructed and operated in a specific orientation, and therefore should not be construed as a limit of the present disclosure. Unless expressly stated and limited otherwise, the terms "mount," "connect," "connected," and "assemble" should be broadly understood, for example, can be fixedly connected, or detachably connected, or integrally formed; can be mechanically connected, and can also be electrically connected; can be directly connected, or can be indirectly connected through an intermediate member, but also can be an internal communication between two components. For those skilled in the art, the specific meanings of the above terms in the present disclosure can be understood with reference to specific cases. In addition, in the description of the present disclosure, unless otherwise specified, the meaning of "a plurality" of is two or more.

Figure 1:
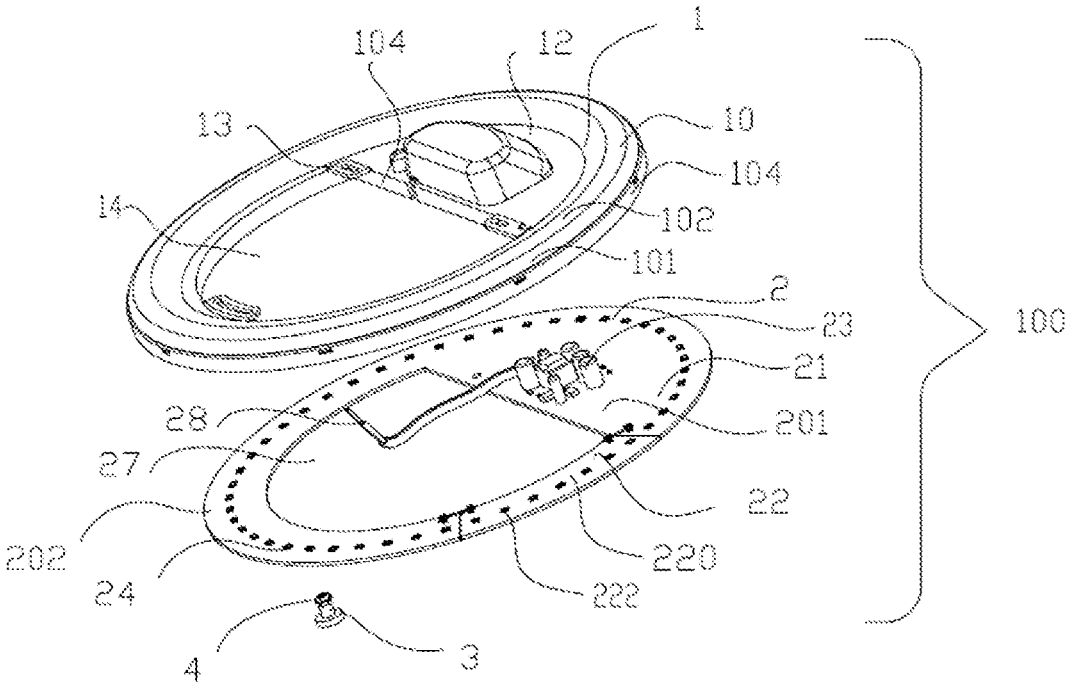
FIG. 1 is a partially exploded perspective view of a lighting apparatus in accordance with an aspect of the present disclosure.
Figure 2:
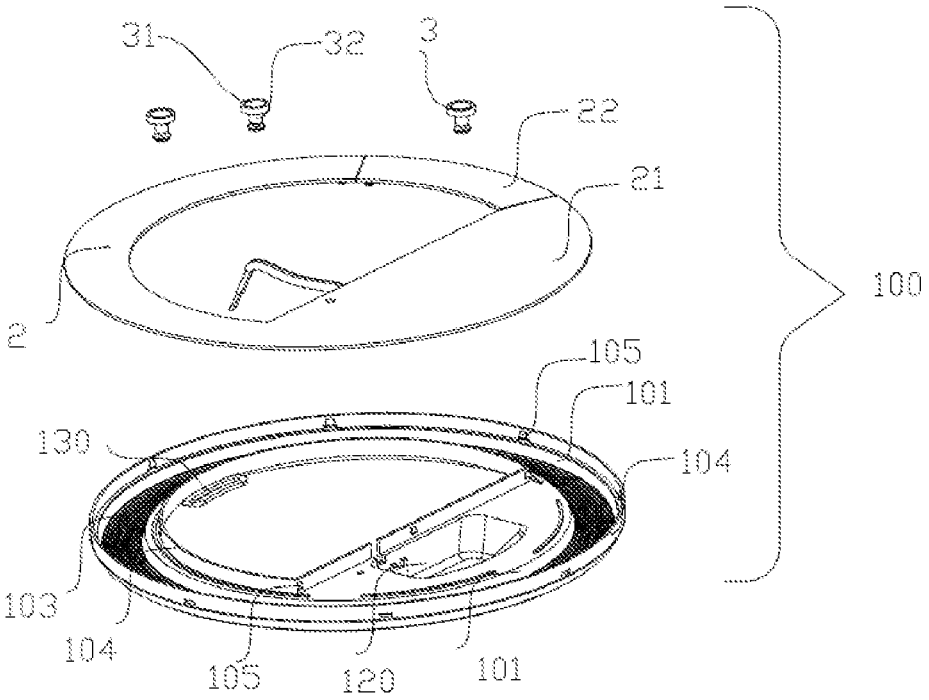
FIG. 2 is an exploded perspective view of the lighting apparatus illustrated in FIG. 1 at another angle.
Figure 3:
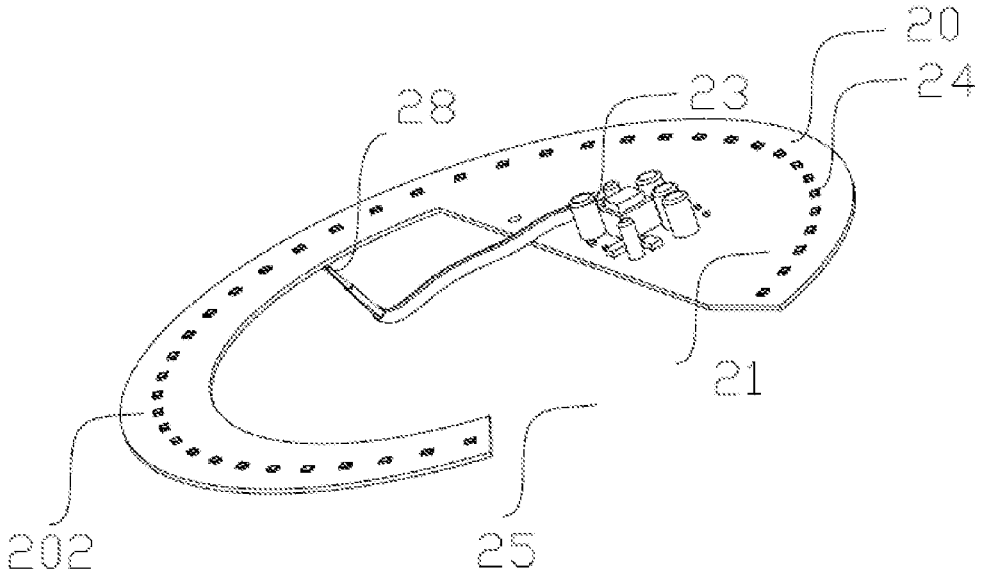
FIG. 3 is a perspective view of a main light source circuitry of a light source circuitry according to an aspect of the present disclosure.

Referring to FIGS. 1-2, a lighting lamp (not shown) according to an aspect of the present disclosure includes a lighting apparatus 100 as illustrated in FIG. 1, a housing (not illustrated) disposed on a mounting base such as a ceiling and a wall, and a lampshade. The lighting apparatus 100 is disposed in the housing, and light emitted by the lighting apparatus is homogenized by the lampshade to provide illumination. Of course, in other preferred embodiments, the lampshade can also be replaced by other optical diffusion elements or light homogenization elements or light guide elements, all of which are included in the scope of the present disclosure. The housing can be made of a metal heat-conducting material.

The lighting apparatus 100 according to an aspect of the present disclosure includes an optical element 1, a light source circuitry 2 assembled with the optical element 1, and a mounting element 3.

The light source circuitry 2 includes a main light source circuitry 21 and a complementary light source circuitry 22 which are spliced with each other.

The main light source circuitry 21 includes: a light source baseplate 20; a driving circuitry 23 and a plurality of light-emitting units 24 which are respectively disposed on the light source baseplate 20 and respectively electrically connected with the light source baseplate 20. In an aspect of the present disclosure, the light-emitting unit 24 is a LED particle, but in other preferred embodiments, it can be any other light-emitting unit/member applicable to the structure. The driving circuitry 23 can also be disposed externally and not included in the main light source circuitry 21. The driving circuitry 23 and an external power line 28 are electrically connected in any possible manner and perform voltage conversion so as to provide power to the light-emitting units 24, 222 of the main light source circuitry 21 and the complementary light source circuitry 22 for driving the light-emitting units 24, 222 to generate light.

The light source plate 20 is e-shaped and includes a semicircular main body 201 and an arc-shaped extension portion 202 formed by extending from an end of the main body 201. A gap 25 is formed between the extension portion 202 and the other end of the main body 201. Several light-emitting units 24 are respectively disposed on an outer periphery of the main body 201 and on an outer periphery of the arc-shaped extension portion 202. A middle of the main body 201 is further provided with a driving circuitry 23. Of course, the light source baseplate 20 can also have other configurations as long as it can accommodate the light-emitting units 24 and the driving circuitry 23.

Figure 9:
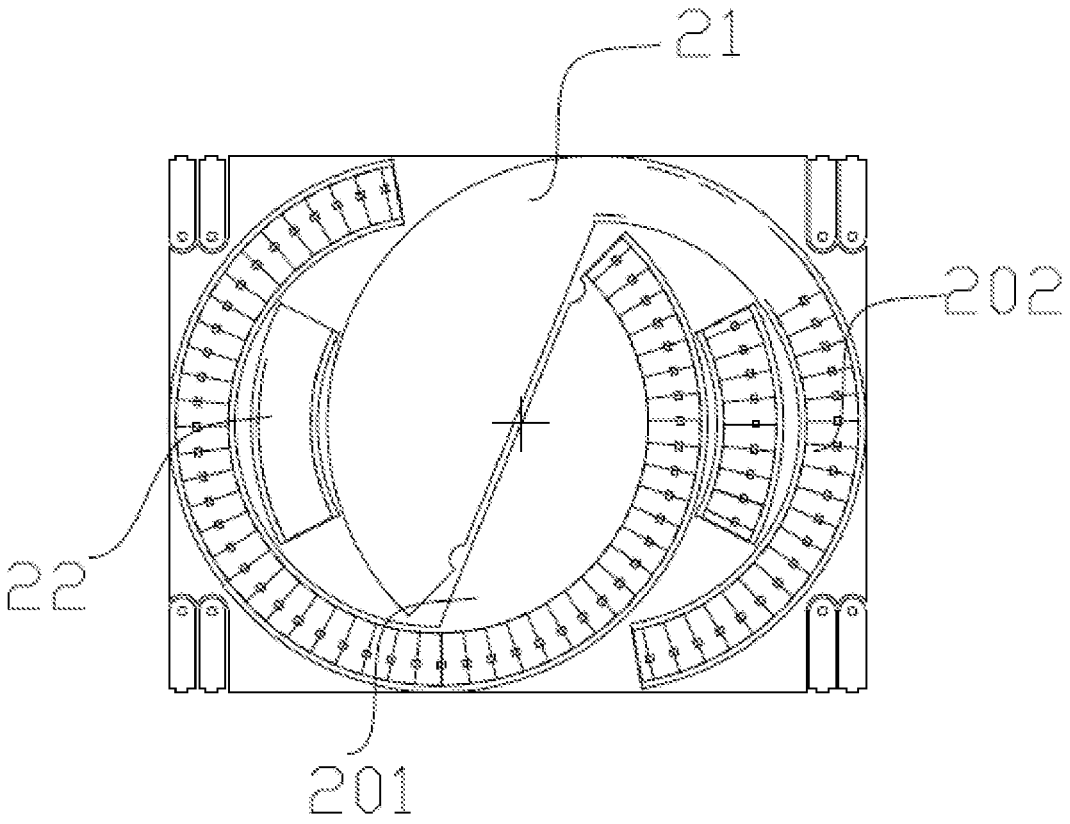
FIG. 9 is a schematic view illustrating cutting and trimming a material of a light source baseplate of a light source circuitry in accordance with an aspect of the present disclosure.

The complementary light source circuitry 22 is arc-shaped, and fills the gap 25; that is, the complementary light source circuitry is located between the extension portion 202 and the main body 201 of the main light source circuitry 21, and is electrically connected to the extension portion 202 and the main body 201, respectively. The complementary light source circuitry 22 includes an arc-shaped light source baseplate 220, and several light-emitting units 222 disposed at intervals. In particular, the light source baseplate 20 of the main light source circuitry 21 and the light source baseplate 220 of the complementary light source circuitry 22 are obtained by cutting and trimming a same piece of light source baseplate material. Therefore, the light source baseplate material is utilized to the maximum extent to avoid material waste, thereby reducing cost. Specifically, referring to FIG. 9, by designing, a rectangular light source baseplate material can be arranged with light source plates 20 of two main light source circuitries 21 and light source plates 220 of two complementary light source circuitries 22. The two light source baseplates 20 are mated with each other, and the two light source baseplates 220 are respectively located between the two light source baseplates 20. Therefore, it can be seen that the rectangular light source baseplate material has been used to the maximum, thereby improving utilization ratio and reducing cost.

Figure 4:
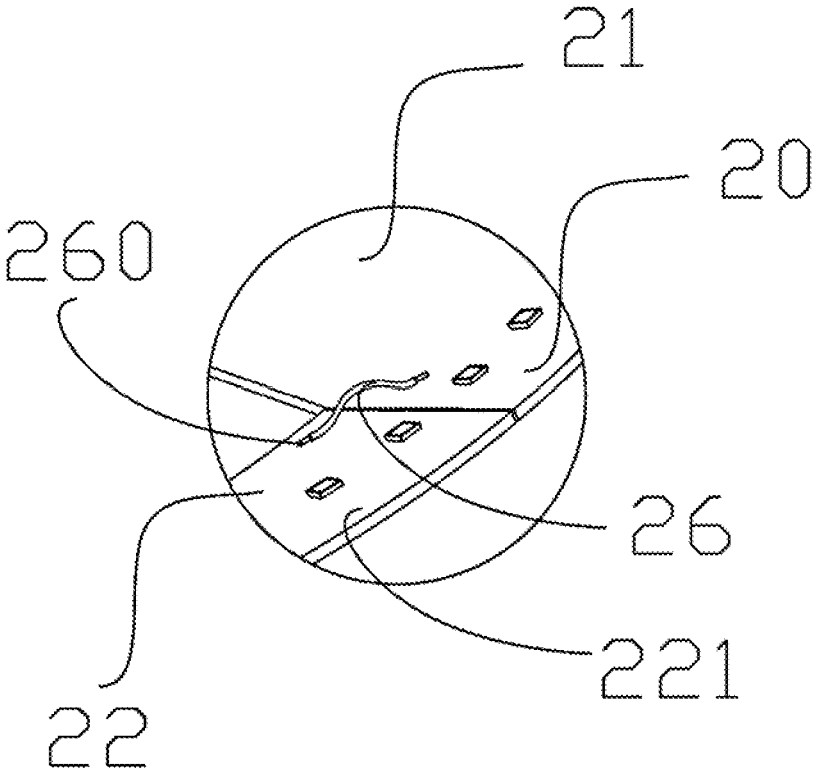
FIG. 4 illustrates a first electrical connection mode of a main light source circuitry and a complementary light source circuitry of the light source circuitry.

After cutting and trimming, the light source baseplate 20 of the main light source circuitry 21 is spliced with the complementary light source circuitry 22; subsequently, referring to FIG. 4, at a location where the main light source circuitry and the complementary light source circuitry are adjoined, a conductive sheet (not shown) can be provided on an upper surface of the light source baseplate 20 of the main light source circuitry and the light source baseplate 220 of the complementary light source circuitry, respectively. A conductive element 26, such as a conductive wire, is electrically connected with the conductive sheet through conductive portions 260 at both ends thereof to form an electrical connection of the light source baseplate 20 and the light source baseplate 220.

Figure 5:
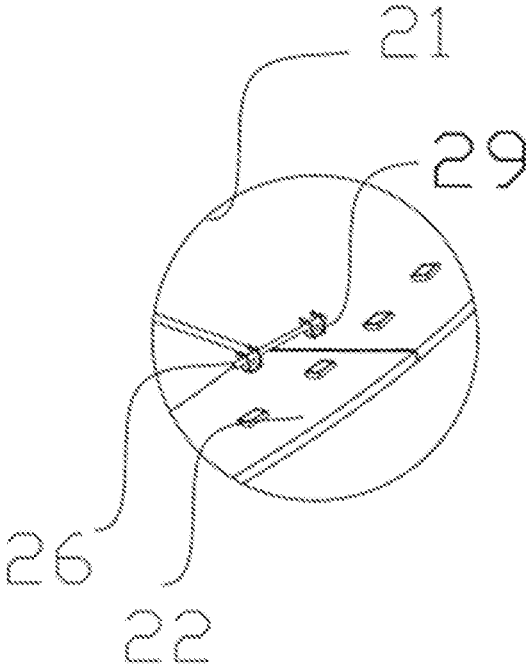
FIG. 5 illustrates a second electrical connection mode of a main light source circuitry and a complementary light source circuitry of the light source circuitry.

Referring to FIG. 5, at the location where the main light source circuitry and the complementary light source circuitry are adjoined, U-shaped conductive terminals 29 electrically connected with the light source baseplate 20 and the light source baseplate 220, respectively, can be provided at free ends of the light source plates 20 and 220, respectively, and then a conductive element 26, such as a wire or other suitable forms, is pressed into a pair of slits (not labeled) formed by the U-shaped conductive terminals 29 so as to be electrically connected with the conductive terminals 29 respectively, thereby realizing the electrical connection between the light source baseplate 20 and the light source baseplate 220. The conductive terminals 29 can be welded to the light source baseplates 20 and 220 and can be further electrically connected with built-in wires of the light source baseplates 20 and 220. In other preferred embodiments, the conductive terminals 29 can also be connected with the light source baseplates 20 and 220 in other suitable manners for electrical connections, such as piercing and press welding method, and integrally built-in method. Of course, the conductive terminals 29 can have other structures to achieve electrical connection with the conductive element 26, such as crimping and welding method. Therefore, after splicing, the main light source circuitry 21 and the complementary light source circuitry 22 constitute a closed configuration, so as to constitute the light source circuitry 2 of the present disclosure, which encloses a semicircular space 27.

Figure 6:
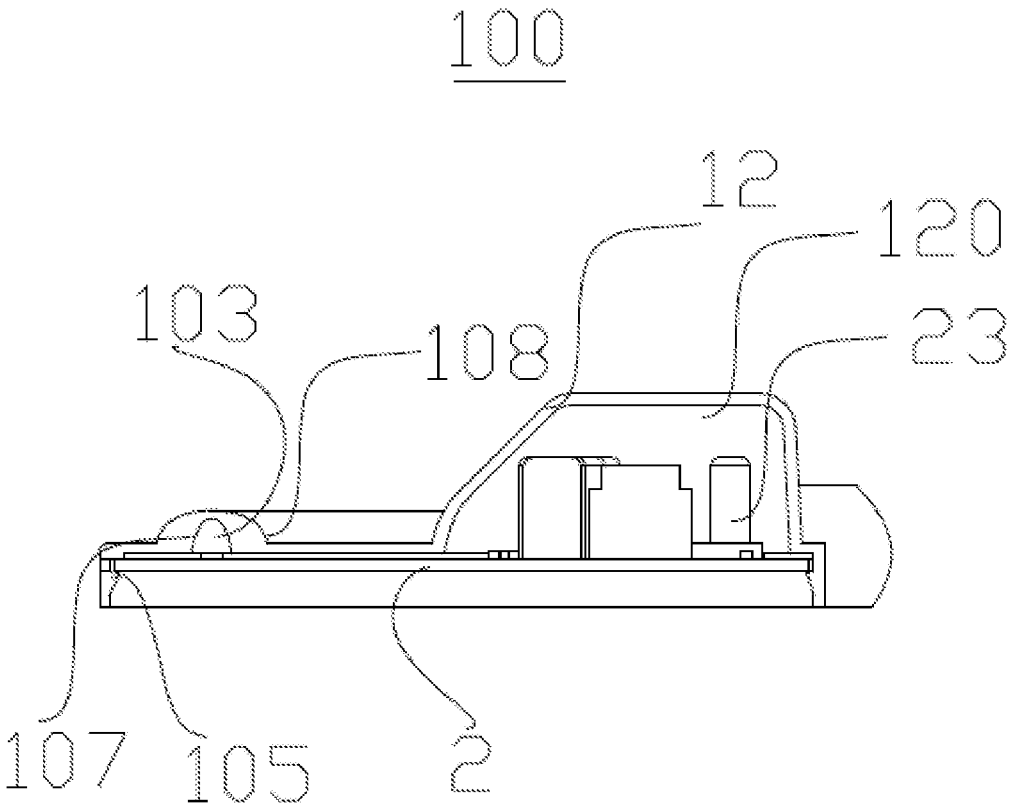
FIG. 6 is a cross-sectional view of an example optical element provided by a lighting apparatus in accordance with an aspect of the present disclosure.
Figure 7:
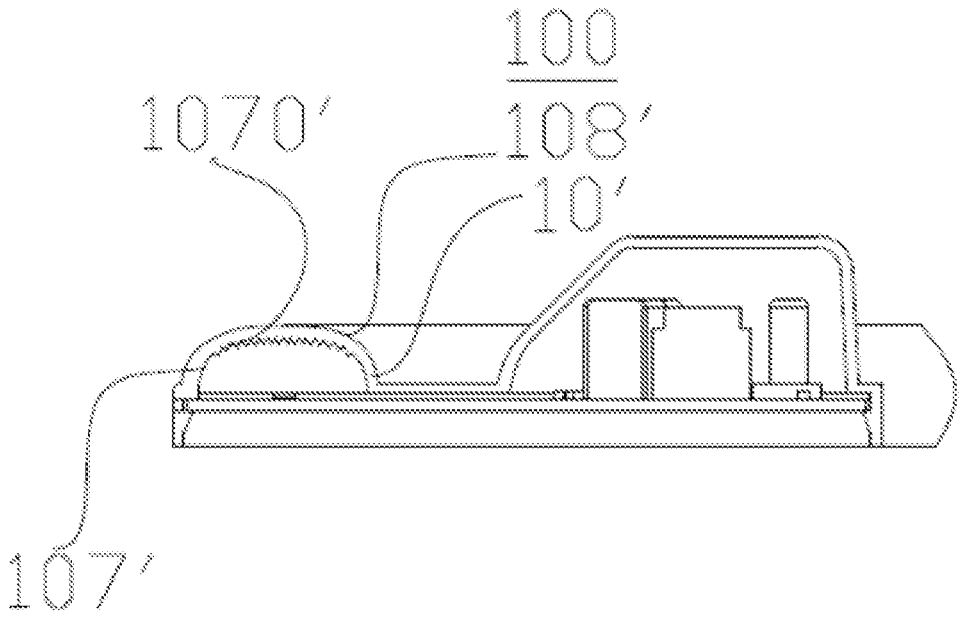
FIG. 7 is cross-sectional views of an example optical element provided by a lighting apparatus in accordance with an aspect of the present disclosure
Figure 8:
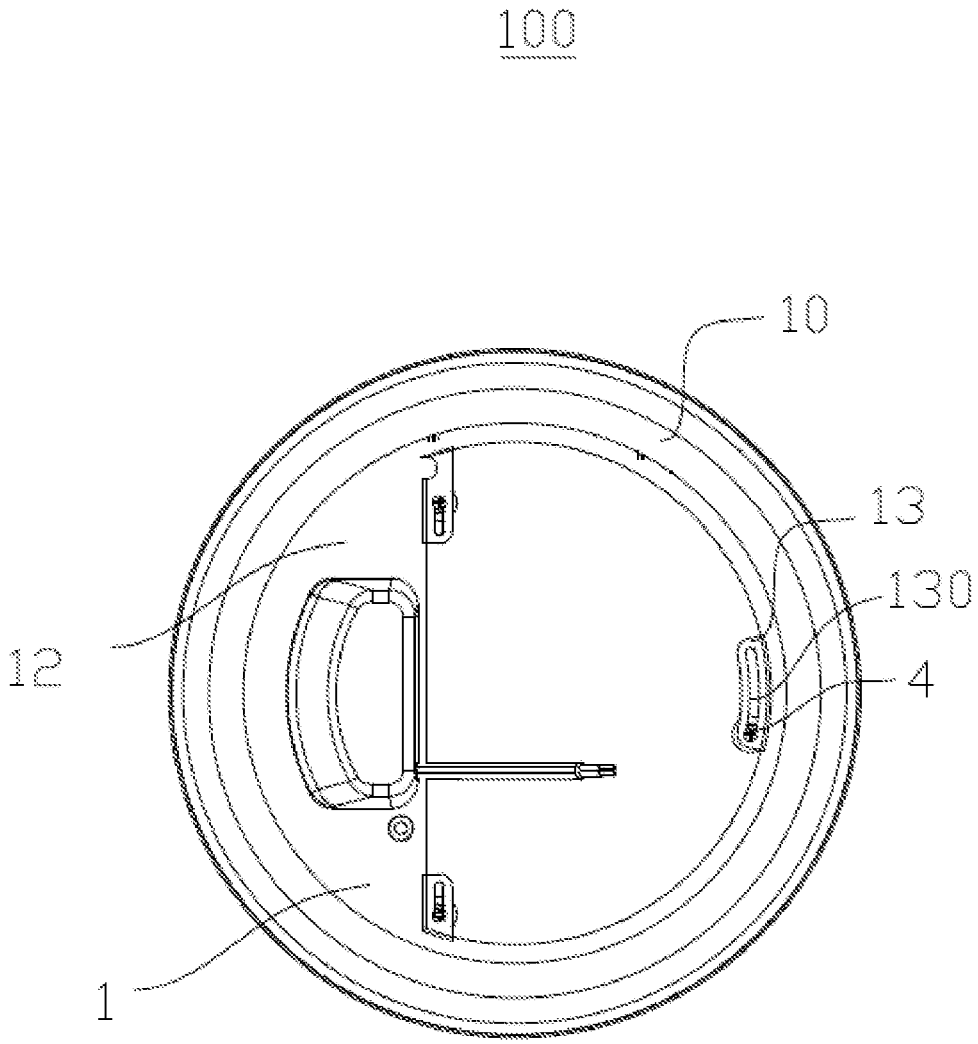
FIG. 8 is a top view of a lighting apparatus in accordance with an aspect of the present disclosure.

The optical element 1 is Alternatively or additionally an integral structure with a circular shape, including an annular optical accommodation region 10 located at an outermost periphery and a semicircular driving accommodation region 12 integrally connected with an arc-shaped segment of the annular optical accommodation region 10. Therefore, a semicircular space 14 corresponding to the space 27 of the light source circuitry 2 is further formed between the optical accommodation region 10 and the driving accommodation region 12. The optical accommodation region 10 includes a pair of side walls 101 opposite to each other, and a top wall 102 which is connected to upper edges of the pair of side walls 101 and is protruded upward slightly. The top wall 101, together with the side walls 102, form an annular optical accommodation groove 103 there-between. Alternatively or additionally, referring to FIG. 6, the optical accommodation region 10 has a light incident surface 107 and a light exit surface 108. An inner surface of the optical accommodation groove 103 is just the light incident surface 107. The optical accommodation region 10 is correspondingly disposed under the light-emitting units 24 and 222 of the light source circuitry 2. Light emitted by the light-emitting units 24 and 222 arrives at the light incident surface 107, respectively, upon passing through the optical accommodation groove 103, and then arrives at the light exit surface 108 upon being refracted at the light incident surface 107, and finally exits upon being further refracted at the light exit surface 108. Therefore, the optical accommodation region 10 is configured to distribute the light emitted by the light-emitting units 24 and 222. The light incident surface 107 and the light exit surface 108 are both curved surfaces, and both are formed as arc concave lenses. Alternatively or additionally, referring to FIG. 7, a light incident surface 107' and a light exit surface 108' can also be curved surfaces with a greater curvature, and the light incident surface 107' is further provided with a microstructure 1070' for further light distribution of the light emitted by the light-emitting units 24 and 222. In an aspect of the present disclosure, the microstructure 1070' has a sawtooth-shaped structure. In addition, the light incident surfaces 107, 107' and the light exit surfaces 108, 108' are fogging surfaces or matte surfaces.

Further, a mounting member 104 is formed to surround an outer periphery of the space 14 and is integrally extending downwardly and slightly outwardly from the sidewall 101 located outside. Therefore, the mounting member 104 has two parts, of which one part is further extending from the side wall 101 located outside and has a circular shape, the other part is formed to surround the space 14 and hence has a semicircular shape. Several snap-clip elements 105 with wedge-like shape are disposed at intervals along opposite inner surfaces of the mounting member 104. The snap-clip elements 105 are respectively spaced apart from a lower edge of the side wall 101 by a predetermined distance in an up-down direction and gradually decrease in thickness along a direction away from the side wall 101. The predetermined distance is comparable to a thickness of the light source baseplate 20 of the light source circuitry 2. Therefore, the light source baseplate 20 can be sandwiched between the snap-clip elements 105 and the side wall 101 along a profile of the light source baseplate 20. A middle portion of the driving accommodation region 12 is bulged to form an accommodating space 120 for correspondingly accommodating electronic components of the driving circuitry 22. Alternatively or additionally, the mounting element 3 is disposed on the optical element 1. In order to achieve a connection between the mounting elements 3 and the optical element 1, several tab-like mounting pieces 13 are formed to be extending into the space 14 from the lower edge of the mounting member 104 surrounding the space 14. Each of the mounting pieces 13 is sheet-shaped, and a slot 130 is opened in a middle of the mounting piece 13. Several screws 4 pass through the slots 130 and are locked at screw holes (not labeled) opened in the mounting elements 3 to achieve an engagement of the mounting elements 3 and the optical element 1. In an aspect of the present disclosure, a head portion of the screw 4 has a dimension larger than a width of the slot 130 so that a threaded portion of the screw passes through the slot 130 but the head portion of the screw is blocked by a periphery of the slot 130. In an aspect of the present disclosure, the mounting element 3 has a magnetic property so as to be attached to a chassis of a lamp by an attractive force, and the lighting apparatus 100 is disposed on the chassis. The chassis is engaged with a mounting base by screws or other mounting means. In this way, the lighting device is installed. The mounting element 3 includes: a coupling portion 31 with a smaller diameter, which is provided with the screw hole and coupled with the screw; and an attraction portion 32 with a larger diameter, which is located at a free end of the coupling portion 31 and has a larger end face so as to provide sufficient attractive force between the mounting element and the chassis. The mounting element 3 can be entirely made of a magnetic material, such as a strong magnet. Alternatively, the coupling portion 31 can also be made of a metal or plastic material, and the attraction portion 32 can be made of a magnetic material, such as a strong magnet, thereby reducing the cost. In other preferred embodiments, the optical element 1 can also be separately arranged, and spliced correspondingly with the main light source circuitry 21 and the complementary light source circuitry 22, respectively.

In the lighting apparatus 100 of the present disclosure, the integrated optical element 1 fully covers the light source circuitry 2 without any exposed electrical components, thereby improving the protection level and avoiding additional use of a protective cover with increased cost. The lighting apparatus 100 can replace existing non-energy saving lamps, lamp panels and the like, and has the advantages of simple structure and convenient installation, which provides great convenience and energy saving for customers.

Alternatively or additionally, the optical accommodation region has a light incident surface and a light exit surface, the light incident surface is facing the optical accommodation groove; and the light emitted by the light-emitting units is incident onto the optical accommodation groove, and then exits upon optically distributed sequentially by the light incidence surface and the light exit surface.

Alternatively or additionally, the light incident surface and the light exit surface both are curved surfaces.

Alternatively or additionally, the light incident surface is provided with a microstructure.

Alternatively or additionally, the light source circuitry includes a main light source circuitry and a complementary light source circuitry, the main light source circuitry and the complementary light source circuitry are electrically connected and spliced with each other to form a closed configuration, the optical element is respectively disposed on the main light source circuitry and the complementary light source circuitry to cover a surface of the main light source circuitry and a surface of the complementary light source circuitry, and the optical element is configured to distribute the light emitted by the light-emitting units of the main light source circuitry and the complementary light source circuitry and then to emit the light.

Alternatively or additionally, the light source baseplate of the main light source circuitry includes a main body and an extension portion formed by extending from one end of the main body, a gap is formed between the extension portion and the other end of the main body, the gap is filled with the complementary light source circuitry, and the complementary light source circuitry is located between the main body and the extension portion of the light source baseplate of the main light source circuitry.

Alternatively or additionally, the main light source circuitry is e-shaped, the complementary light source circuitry is circular arc-shaped, and the complementary light source circuitry and the main light source circuitry are spliced together so as to be closed.

Alternatively or additionally, the main light source circuitry and the complementary light source circuitry respectively have a light source baseplate and a plurality of light-emitting units disposed on the light source baseplate. At a location where the main light source circuitry and the complementary light source circuitry are adjoined with each other, each of the main light source circuitry and the complementary light source circuitry is electrically connected to its respective light source baseplate through a conductive element.

Alternatively or additionally, the light source baseplate of the main light source circuitry and the light source baseplate of the complementary light source circuitry are integrally provided with an electrical connector, and the electrical connector is electrically connected to the conductive element to realize an electrical connection of the main light source circuitry and the complementary light source circuitry.

Alternatively or additionally, the optical element is connected with the main light source circuitry and the complementary light source circuitry by a snap-clip element, respectively.

Alternatively or additionally, a space is formed between the driving accommodation region and the optical accommodation region, and at least one mounting piece is disposed along a circumferential side of the space, a mounting element is engaged with the mounting piece.

Alternatively or additionally, the mounting element is locked at the mounting piece by a screw.

Alternatively or additionally, the mounting element is at least partially a permanent magnet, and is configured to be attached onto a chassis of a lighting lamp by an attractive force.

Alternatively or additionally, the optical accommodation region has a light incident surface and a light exit surface, the light incident surface is facing the optical accommodation groove, and the light emitted by the light-emitting units is incident onto the optical accommodation groove and then exits upon optically distributed sequentially by the light incidence surface and the light exit surface.

Alternatively or additionally, the light incident surface and the light exit surface both are curved surfaces.

Alternatively or additionally, the light incident surface is provided with a microstructure.

Alternatively or additionally, a space is formed between the driving accommodation region and the optical accommodation region, at least one mounting piece that is at least partially a permanent magnet is disposed along a circumferential side of the space, and a mounting element is engaged with the mounting piece.

Alternatively or additionally, the mounting element is locked at the mounting piece by a screw.

It should be noted that the embodiments of the present disclosure are preferred embodiments and not intended to limit the present disclosure in any way. Any skilled person familiar with the art can use the above-disclosed technical content to change or modify the equivalent effective embodiments, any modifications, or equivalent changes and modifications made to the above embodiments according to the technical essence of the present disclosure all fall within the scope of the technical solutions of the present disclosure without departing from the contents of the technical solutions of the present disclosure.

The invention claimed is:

1. A lighting apparatus, comprising:

a light source circuitry having a light source substrate, a plurality of light-emitting units arranged in an annular shape on the light source substrate, and a driving circuitry located in an annular region on the light source substrate, the annular region being surrounded by the light-emitting units, wherein the light source substrate comprises a semicircular main body and an extension portion, and the driving circuitry is disposed on the semicircular main body; and an optical element comprising an annular optical accommodation region located at an outer periphery and a driving accommodation region located in a region surrounded by the optical accommodation region, the driving accommodation region being protruded from the optical accommodation region; the optical accommodation region being provided with an optical accommodation groove facing the light-emitting units, the optical accommodation groove being configured to accommodate the light-emitting units, wherein light emitted by the light-emitting units are incident onto the optical accommodation groove and then exit upon being distributed; and wherein the driving circuitry of the light source circuitry is correspondingly accommodated in the driving accommodation region.

2. The lighting apparatus according to claim 1, wherein the optical accommodation region comprises a light incident surface and a light exit surface, and the light incident surface faces the optical accommodation groove, and wherein the light emitted by the light-emitting units is incident onto the optical accommodation groove, and then exits upon being optically distributed sequentially by the light incident surface and the light exit surface.

3. The lighting apparatus according to claim 2, wherein the light incident surface and the light exit surface both are curved surfaces.

4. The lighting apparatus as claimed in claim 2, wherein the light incident surface is provided with a microstructure.

5. The lighting apparatus according to claim 1, wherein the light source circuitry comprises a main light source circuitry and a complementary light source circuitry, each of the main light source circuitry and the complementary light source circuitry has a light source baseplate, the main light source circuitry and the complementary light source circuitry are electrically connected and spliced with each other to form a closed configuration, the optical element is disposed on the main light source circuitry and the complementary light source circuitry, to cover a surface of the main light source circuitry and a surface of the complementary light source circuitry, and the optical element is configured to distribute the light emitted by the light-emitting units of the main light source circuitry and the complementary light source circuitry, so that the light exits upon being distributed.

6. The lighting apparatus according to claim 5, wherein the light source baseplate of the main light source circuitry comprises a main body and an extension portion formed by extending from one end of the main body, and wherein a gap is between the extension portion and the other end of the main body, the gap is filled with the complementary light source circuitry, and the complementary light source circuitry is located between the main body and the extension portion of the light source baseplate of the main light source circuitry.

7. The lighting apparatus according to claim 6, wherein the main light source circuitry is e-shaped, the complementary light source circuitry is circular arc-shaped, and the complementary light source circuitry and the main light source circuitry are spliced together so as to be closed.

8. The lighting apparatus according to claim 5, wherein the main light source circuitry and the complementary light source circuitry have a light source plate and a plurality of light-emitting units are disposed on the light source baseplate, and wherein at a location where the main light source circuitry and the complementary light source circuitry are adjoined, each of the main light source circuitry and the complementary light source circuitry is electrically connected to its respective light source baseplate through a conductive element.

9. The lighting apparatus according to claim 8, wherein the light source baseplate of the main light source circuitry and the light source baseplate of the complementary light source circuitry are integrally provided with an electrical connector, and the electrical connector is electrically connected to the conductive element to realize an electrical connection of the main light source circuitry and the complementary light source circuitry.

10. The lighting apparatus according to claim 5, wherein the optical element is connected to the main light source circuitry and the complementary light source circuitry by a snap-clip element.

11. The lighting apparatus according to claim 1, wherein a space is formed between the driving accommodation region and the optical accommodation region, and at least one mounting piece is disposed along a circumferential side of the space, wherein the circumferential side is bounded by the driving accommodation region and the optical accommodation region, a mounting element is engaged with the at least one mounting piece.

12. The lighting apparatus according to claim 11, wherein the mounting element is engaged with the mounting piece by a screw.

13. An optical element comprising:

an annular optical accommodation region located at an outer periphery and a driving accommodation region located in a region surrounded by the optical accommodation region, the driving accommodation region being protruded from the optical accommodation region;

the optical accommodation region being provided with an optical accommodation groove facing light-emitting units, the optical accommodation groove being configured to accommodate the light-emitting units, light emitted by the light-emitting units being incident onto the optical accommodation groove and then exiting upon being distributed; and a driving circuitry of a light source circuitry being correspondingly accommodated in the driving accommodation region, and the driving circuitry disposed on an annular region on a light source substrate, wherein the light source substrate comprises a semicircular main body and an extension portion, and the driving circuitry is disposed on the semicircular main body.

14. The optical element according to claim 13, wherein the optical accommodation region has a light incident surface and a light exit surface, the light incident surface faces the optical accommodation groove, and wherein the light emitted by the light-emitting units is incident onto the optical accommodation groove and then exits upon being optically distributed sequentially by the light incident surface and the light exit surface.

15. The optical element according to claim 13, wherein the light incident surface and the light exit surface both are curved surfaces.

16. The optical element according to claim 13, wherein the light incident surface is provided with a microstructure.

17. The optical element according to claim 13, wherein a space is formed between the driving accommodation region and the optical accommodation region, at least one mounting piece, at least partially being a permanent magnet, is disposed along a circumferential side of the space, wherein the circumferential side is bounded by the driving accommodation region and the optical accommodation region, and a mounting element is engaged with the at least one mounting piece.

18. The optical element according to claim 16, wherein the mounting element is engaged with the mounting piece by a screw.

19. A lighting lamp, comprising a lighting apparatus that comprises:

a light source circuitry having comprising a light source substrate, a plurality of light-emitting units arranged in an annular shape on the light source substrate, and a driving circuitry located on an annular region on the light source substrate, the annular region being surrounded by the light-emitting units, wherein the light source substrate comprises a semicircular main body and an extension portion, and the driving circuitry is disposed on the semicircular main body; and an optical element comprising an annular optical accommodation region located at an outer periphery and a driving accommodation region located in a region surrounded by the optical accommodation region, the driving accommodation region being protruded from the optical accommodation region; the optical accommodation region being provided with an optical accommodation groove facing the light-emitting units, the optical accommodation groove being configured to accommodate the light-emitting units, wherein light emitted by the light-emitting units are incident onto the optical accommodation groove and then exit upon being distributed; and wherein the driving circuitry of the light source circuitry is correspondingly accommodated in the driving accommodation region.

* * * * *